US010486719B2

(12) United States Patent
Vithani

(10) Patent No.: US 10,486,719 B2
(45) Date of Patent: Nov. 26, 2019

(54) RAILROAD COUPLER KNUCKLE WITH EXTERNAL WEIGHT REDUCING FEATURES AND METHOD OF FORMING THE SAME

(71) Applicant: JAC Operations, Inc., Chicago, IL (US)

(72) Inventor: Anand R. Vithani, Addison, IL (US)

(73) Assignee: JAC OPERATIONS, INC., Chicago, IL (US)

( * ) Notice: Subject to any disclaimer, the term of this patent is extended or adjusted under 35 U.S.C. 154(b) by 259 days.

(21) Appl. No.: 15/438,858

(22) Filed: Feb. 22, 2017

(65) Prior Publication Data

US 2017/0240189 A1 Aug. 24, 2017

Related U.S. Application Data

(60) Provisional application No. 62/297,990, filed on Feb. 22, 2016.

(51) Int. Cl.
*B61G 7/00* (2006.01)
*B61G 3/04* (2006.01)

(52) U.S. Cl.
CPC ..... *B61G 7/00* (2013.01); *B61G 3/04* (2013.01)

(58) Field of Classification Search
CPC ..... B61G 7/00; B61G 3/04
USPC ..... 213/155
See application file for complete search history.

(56) References Cited

U.S. PATENT DOCUMENTS

| | | | | |
|---|---|---|---|---|
| 138,405 | A | 4/1873 | Janney | |
| 4,605,133 | A | 8/1986 | Altherr | |
| 5,954,212 | A | 9/1999 | Beatty et al. | |
| 6,129,227 | A * | 10/2000 | Openchowski | B61G 3/04 213/111 |
| 8,297,455 | B2 | 10/2012 | Smyth | |
| 8,302,790 | B2 | 11/2012 | Dumey | |
| 8,381,923 | B2 | 2/2013 | Smyth | |
| 8,485,371 | B2 | 7/2013 | Nibouar et al. | |
| 8,499,819 | B2 | 8/2013 | Nibouar et al. | |
| 8,631,952 | B2 | 1/2014 | Smerecky | |
| 8,646,631 | B2 | 2/2014 | Marchese et al. | |
| 8,662,327 | B2 | 3/2014 | Nibouar et al. | |
| 9,038,836 | B1 * | 5/2015 | Tavares | B61G 3/04 213/154 |
| 9,199,652 | B1 | 12/2015 | Brook et al. | |
| 2009/0289023 | A1 * | 11/2009 | Marchese | B22C 9/103 213/155 |
| 2011/0068077 | A1 * | 3/2011 | Smyth | B22C 9/04 215/155 |
| 2012/0217217 | A1 | 8/2012 | Smerecky | |
| 2014/0217051 | A1 * | 8/2014 | Brook | B61G 3/04 213/155 |

(Continued)

*Primary Examiner* — Jason C Smith
(74) *Attorney, Agent, or Firm* — Blynn L. Shideler; Krisanne Shideler; BLK Law Group

(57) ABSTRACT

A railroad coupler knuckler meets AAR contour requirements and it includes unique external weight reducing features that strategically reduce weight without compromising strength or fatigue life. The design of the railroad knuckle of the present invention allows for formation of the knuckle through forging or coreless casting techniques and thus allows for the use of a better grade of steel compared to AAR Grade E and such forged or cast knuckle will yield much higher fatigue life compared to cast knuckles.

20 Claims, 8 Drawing Sheets

(56) References Cited

U.S. PATENT DOCUMENTS

| | | | | |
|---|---|---|---|---|
| 2014/0217052 | A1* | 8/2014 | Brook | B61G 3/04<br>213/155 |
| 2017/0240189 | A1* | 8/2017 | Vithani | B61G 7/00 |

* cited by examiner

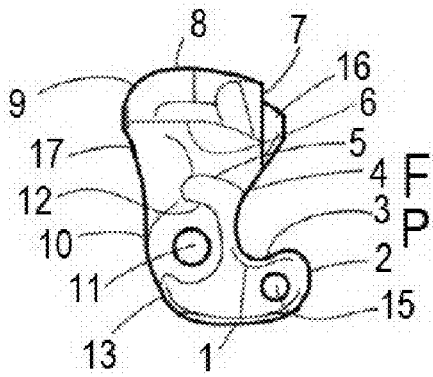
FIG. 1A
PRIOR ART
FIG. 1D
PRIOR ART
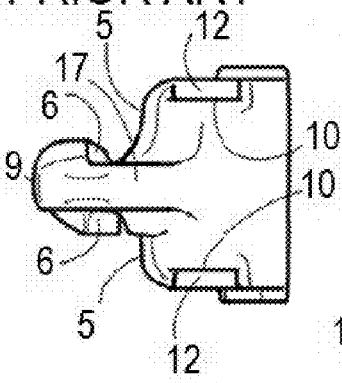
FIG. 1B
PRIOR ART
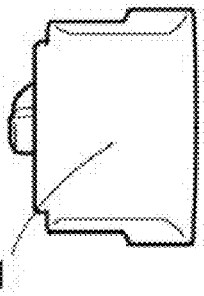
FIG. 1E
PRIOR ART
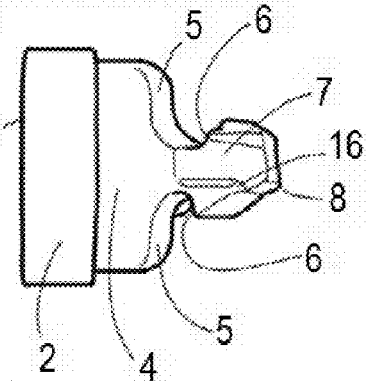
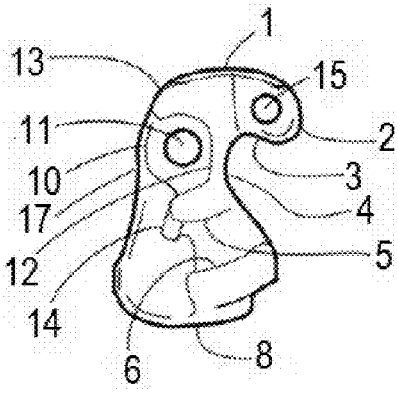
FIG. 1C
PRIOR ART

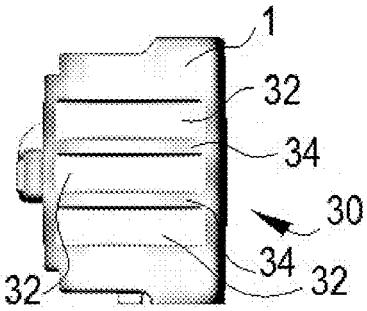
FIG.15A
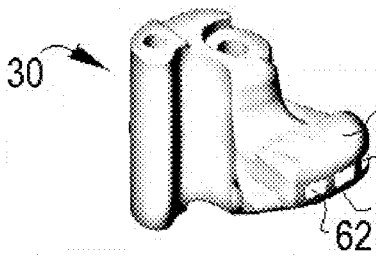
FIG.15B
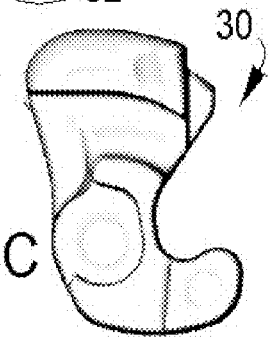
FIG.15C
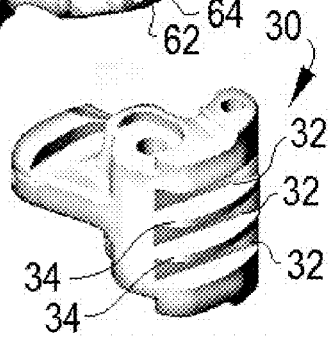
FIG.15D
FIG.16A
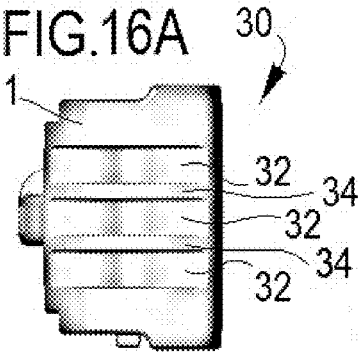
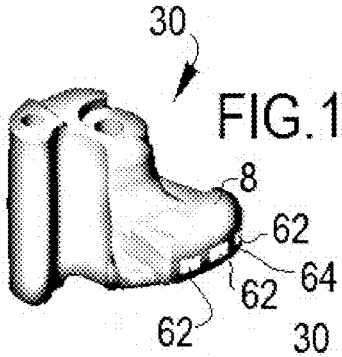
FIG.16B
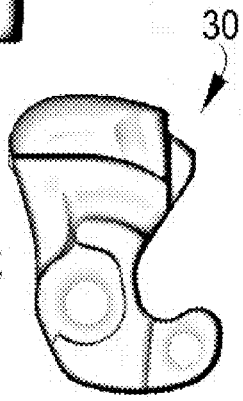
FIG. 16C
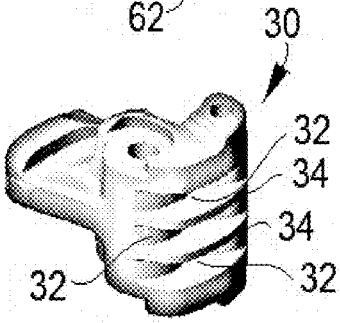
FIG.16D

RAILROAD COUPLER KNUCKLE WITH EXTERNAL WEIGHT REDUCING FEATURES AND METHOD OF FORMING THE SAME

RELATED APPLICATIONS

This application claims priority to U.S. Patent Application Ser. No. 62/297,990 filed Feb. 22, 2016, entitled "Railroad Coupler Knuckle with External Weight Reducing Features" which is incorporated herein by reference.

BACKGROUND INFORMATION

1. Field of the Invention

The present invention relates to railroad couplings, and more particularly to a railroad coupler knuckle having external weight reducing features and a method of forming the same.

2. Background Information

A railroad coupling (or a coupler) is a device for connecting rolling stock, i.e. the railcars, in a train. The design of the coupler is standard, and is almost as important as the track gauge, since flexibility and convenience are maximized if all rolling stock can be easily and quickly coupled together. The equipment that connects the couplings to the rolling stock is known as the draft gear.

The Janney Coupler is a semi-automatic railway knuckle coupler. The earliest commercially successful version of the semi-automatic Knuckle Coupler was patented by Eli H. Janney in 1873 bearing U.S. Pat. No. 138,405 which is incorporated herein by reference. Mr. Janney, a major in the Confederate Army during the American Civil War and serving on Gen. Robert E. Lee's staff, was a dry goods clerk post war in Alexandria Va., home of the modern day United States Patent and Trademark Office, where he developed his knuckle coupler. The City of Alexandria named one of their streets in his honor, Janney's Lane.

In 1893, satisfied that a semi-automatic knuckle coupler could meet the demands of commercial railroad operations and, at the same time, be manipulated safely, the United States Congress passed the Safety Appliance Act (SAA). Its success in promoting switchyard safety was stunning. Between 1877 and 1887, approximately 38% of all rail worker accidents involved coupling. That percentage fell as the railroads began to replace link and pin couplers with automatic couplers. By 1902, only two years after the SAA's effective date, coupling accidents constituted only 4% of all employee accidents. Coupler-related accidents dropped from nearly 11,000 in 1892 to just over 2,000 in 1902, even though the number of railroad employees steadily increased during that decade. Thus the semi-automatic knuckle coupler has played a critical role in improving railway safety for workers.

In the United Kingdom, where the semi-automatic knuckle coupler is fitted to some rolling stock, mostly for passenger trains, it is also known as a "Buckeye Coupler", possibly originating from the coupler's manufacture as early as 1890 by the Buckeye Steel Castings firm in Columbus, Ohio. The AAR/APTA Type E, Type F, and Type H tightlock couplers are all compatible semi-automatic Knuckle couplers, but are employed on specific types rail cars (general freight, tank cars, rotary hoppers, passenger, etc.).

Prior to the formation of the AAR (Association of American Railroads) these types of couplers were known as MCB Couplers (Master Car Builders Association). After 1910 the MCB reconstituted itself into the AAR. In 1913 the American Steel Foundries (ASF) had developed the new Type "D" coupler that was accepted as the standard coupler for the USA, and no new equipment could be built using any other coupler. This standard design ended the market for couplers with a proprietary head design, which were common in the MCB days, to all but those exported from the USA to other countries not governed by the AAR standards. The Interlocking contour of knuckle couplers was the first aspect to be standardized. In the MCB years, prior to about 1910, there were many proprietary "head" designs, and many MCB standard contours, which were constantly evolving and changing (as the approved standard contour for new couplers) every few years.

In about 1910 the producers were all using the then standardized MCB-10 contour, soon to become the AAR-10. In 1930 the AAR Type "D" was improved and became the Type "E"; the contour, however, stayed the same. A few years later the 10 contour was modified into a then optional standard called the 10A contour.

The most modern contour, for a plain Type "E" knuckle coupler, is still the AAR-10 and 10A, which are largely indistinguishable from the 1910 era MCB-10 contour. The same MCB-10 contour has been an approved standard for interchange service for over 100 years, with only the slightest dimensional changes. The Type "H" or "tight-lock" couplers, which are used on passenger-carrying rolling stock, also use slight revisions to the old 10A contour. Type H coupler, also called a "tight-lock" variation, is intended to reduce slack action and improve safety for passenger cars is now under the supervision of the APTA (American Public Transportation Association).

The conventional knuckle currently available is a cast knuckle that includes cored sections, such as disclosed in U.S. Pat. No. 4,605,133. The front core of a knuckle is commonly referred to as the finger core. The finger core is commonly constructed to produce an internal cavity having thin ribs. These ribs made out of the standard grade E cast steel have demonstrated a weakness to the load environment with the development of fatigue and/or hot tear cracks. The fatigue cracks can grow over time and eventually lead to knuckle failure which results in separation of railcars. Separately, internal or external cracks in the knuckle are a cause for replacement of the knuckle. The rear core of a knuckle is commonly referred to as the kidney core. Knuckles can sometimes break within this portion of the knuckle and this has proven to be a very undesirable location for a failure. A failure in this region of the knuckle can lead to knuckle jamming within the coupler body and prevent a change out of a failed knuckle, thereby requiring the entire coupler assembly to be replaced, a very costly repair.

U.S. Pat. No. 5,954,212 discloses a lightweight knuckle for use in an AAR Standard E or F type railroad car couplers. The outer contouring and inner voids of the knuckle are radically changed from an existing AAR Standard knuckle. The nose of the knuckle is provided with a pair of parallel, coplanar flat surfaces between which is a projection which extend outwardly from the flat surfaces and terminates at an outer curved surface which has the same curvature as the corresponding curvature of the existing AAR Standard knuckle. U.S. Pat. No. 6,129,227 discloses a similar lightweight knuckle.

U.S. Pat. No. 8,302,790 discloses a railway coupler knuckle which has a cavity formed inside the tail portion and at least a portion of the transition portion and a first wall extends between surfaces of the cavity adjacent the transition portion.

U.S. Patent Application Publication 2012-0217217 discloses a cast coupler knuckle formed with internal cavities without using a conventional finger core. See also U.S. Pat. Nos. 8,662,327, 8,646,631, 8,631,952, 8,499,819, 8,485,371.

U.S. Pat. Nos. 8,297,455 and 8,381,923 disclose a knuckle for a railway coupler system made without internal voids or cores. Instead, external circular or disc shaped pockets are formed on the front face and tail portion surface to reduce weight. The knuckle is formed by investment casting (a process based upon lost-wax casting).

U.S. Pat. No. 9,038,836 discloses a lightweight, coupler which is constructed from cast austempered ductile iron.

U.S. Pat. No. 9,199,652 discloses a lightweight, fatigue resistant knuckle utilizing improved internal coring and/or rib arrangements using an austempered metal, such as, for example, austempered ductile iron, austempered steel, as well as other austempered metals and austempered metal alloys.

The above identified patents and publications are incorporated herein by reference. There remains a need in the art for railroad coupler knuckles that reduce weight, improve manufacturability and improve fatigue life.

SUMMARY OF THE INVENTION

This invention is directed to a railroad coupler knuckle with external weight reducing features. The railroad coupler knuckler of the present invention meets AAR contour requirements and it includes unique external weight reducing features that strategically reduce weight without compromising strength or fatigue life.

The design of the railroad knuckle of the present invention allows for formation of the knuckle through forging techniques and thus allows for the use of a better grade of steel compared to AAR Grade E and such forging processes will yield much higher fatigue life compared to cast knuckles.

One aspect of the invention provides an E-type coupler knuckle comprising a front face configured to transmits the buff forces of the train; and at least two external weight saving pockets with at least one intervening support ridge on the front face of the knuckle extending into the knuckle from an exterior surface of the knuckle, and wherein each external weight saving pocket is a structure that is capable of being formed in one of a forging operation or casting operation without requiring an internal core. A method of forming the coupler is disclosed.

The elements that characterize the present invention are pointed out with particularity in the claims which are part of this disclosure. These and other aspects of the invention, its operating advantages and the specific objects obtained by its use will be more fully understood from the following detailed description in connection with the attached figures.

BRIEF DESCRIPTION OF THE FIGURES

FIGS. 1A-E are five elevation views showing a front, top, bottom, left and right side views of a conventional prior art E-type coupler knuckle illustrating the surfaces thereof;

FIGS. 15A-D and 16-A-D are views of a forged knuckle according to the present invention which includes external weight savings features on the tail and the front face.

DESCRIPTION OF THE PREFERRED EMBODIMENTS

Figure 2:
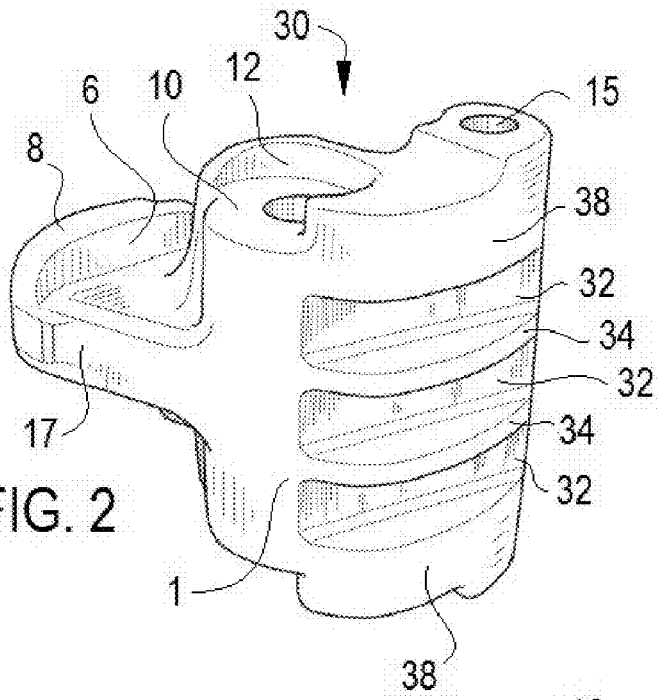
FIGS. 2-4 are perspective views of an E-type knuckle according to aspects of the present invention which include external weight saving features with intervening support ridges on the front face of the knuckle.

A conventional E-type coupler knuckle is well known to those of ordinary skill in the art, however it may be illustrative to review the structure of a conventional coupler to explain the present invention and the positioning of the weight saving external features of the present invention.

A conventional E-type coupler knuckle, as shown in FIGS. 1A-E, includes a front face 1, which can be described as one of the surfaces of the knuckle that transmits the buff forces of the train. For reference the buff forces are the compressive forces (e.g., the cars coming together) and draft forces are the tensile forces (e.g., the cars moving apart). The nose 2 of the conventional e-type coupler knuckle is the primary contour of the knuckle that allows the coupler to mate with the adjacent coupler (via coupler knuckle rotated 180 degrees about a vertical axis).

The pulling face 3 is the surface of the knuckle that transmits the draft forces through coupler. The throat 4 of the knuckle is the narrow portion on the inside of the knuckle which transitions from the pulling face 3 to the tail 8. The two buffing shoulders 5 work together with the front face 1 to transmit buff forces into the coupler body through cooperating or corresponding surfaces on the coupler body.

The pulling lugs 6 are formed by a combination of a substantially straight surface and a curved or radial surface and each lug 6 engages a corresponding surface on the coupler body to transmit draft forces through the pulling lug 6 into the coupler body. The locking face 7 is a generally flat surface configured to abut the coupler lock when the lock has dropped into the locked or coupled position. In the locked or coupled position the coupler lock is sitting on the lock shelf 16 (discussed below) and the lock in this position resists the moment created by the draft forces.

The tail 8 of the E-type coupler knuckle is a contoured surface that allows the knuckle pivot between coupled and uncoupled position. Further the top of the tail 8 provides surface for the lock to ride upon as knuckle is pivoted to a position in which the lock drops onto the lock shelf 16 to lock the coupler knuckle in position. A tail pad is opposite the tail lock and resists the moment created by the buff forces. The tail pad may be pronounced (larger) to reduce slack in the knuckle.

The tail stop 9 is the surface of the knuckle that engages with the coupler wall in the buff mode and may be considered the portion of the knuckle which transitions from the tail 8 to the spine 17 (discussed below).

The coupler knuckle includes a hub feature 10 around the pin. It is meaningful to note that if knuckle works correctly (i.e. it is not worn) then no buff or draft forces are transmitted through the pin itself. The knuckle includes a pivot pin hole 11 configured to receive a pivot pin there through, about which the coupler can rotate with the lock out of the locked position. It is known that the pivot pin hole 11 may include relief cuts or grooves to prevent binding of the pin, as known in the art. The knuckle further includes pin protector surfaces 12 that are configured such that they cooperate with coupler components to transmit forces if knuckler starts to wear. In other words the surfaces 12 are configured to protect the pin.

The coupler knuckle includes a heel 13 that may be considered as the transition from the front face 1 to the hub feature 10. Further, a thrower pad 14 is included in a bottom portion of knuckle and this pad 14 cooperates with a feature of the thrower that moves with upward lifting of the lock to push against the thrower pad to pivot the knuckle open. The thrower pivots the knuckle as the lock is lifted out of the locked position.

The coupler knuckle includes a flag hole 15 which is configured to receive a safety indicator flag, which gives a universal visual indication not to couple to the car. The flag is used on a leading car when work is being conducted in an area in which coupling of the train of cars must be avoided. As noted above the knuckle includes a lock shelf 16 which is configured to hold the lock when it has dropped into the locked or in the secured position. Finally the E-type knuckle includes a spine 17 which is considered the transition surface from the tail stop 9 to the hub feature 10.

FIG. 2 is a perspective view of an E-type knuckle 30 according to one aspect of the present invention and this includes three external weight saving features 32 or pockets with intervening support ridges 34 on the front face 1 of the knuckle 30. The bottom of the weight saving features 32 for this embodiment are flat.

Within the meaning of this application an external weight saving pocket is a feature extending into the knuckle 30 from an exterior surface of the knuckle 30, and is a structure that is capable of being formed in a forging operation or casting operation without requiring an internal core. The design of the railroad knuckle 30 of the present invention allows for formation of the knuckle through forging techniques and thus allows for the use of a better grade of steel compared to AAR Grade E and such forging processes will yield much higher fatigue life compared to cast knuckles.

The weight saving features 32 of FIG. 2 are substantially rectangular recesses orientated horizontally across the front face 1, with horizontal being defined generally in the operational orientation of the knuckle 30 in which the pivot pin hole 11 will be orientated vertically in operation. The support ridges 34 of FIG. 2 are thick horizontal structures, those illustrated being uniform meaning a thickness variation of +/−less than 3%, extending horizontally across the front face 1. The rectangular recesses of FIG. 2 forming weight saving features 32 extend at least 70% of the width of the front face 1, at least between the axis of the pin hole 11 and the axis of the flag hole 15 in a front elevation view (technically the front elevation view is a vertical viewing plane perpendicular to the buff and draft forces). The knuckle 30 includes a continuous surface 38 on the front face 1 on the top and the bottom of the front face 1 into which the weight saving features 32 do not extend such that these weight saving features 32 do not interfere with the operation of the knuckle 30. The surfaces 38 have a vertical depth at least equal to the vertical depth of the pin protector 12.

Figure 3:
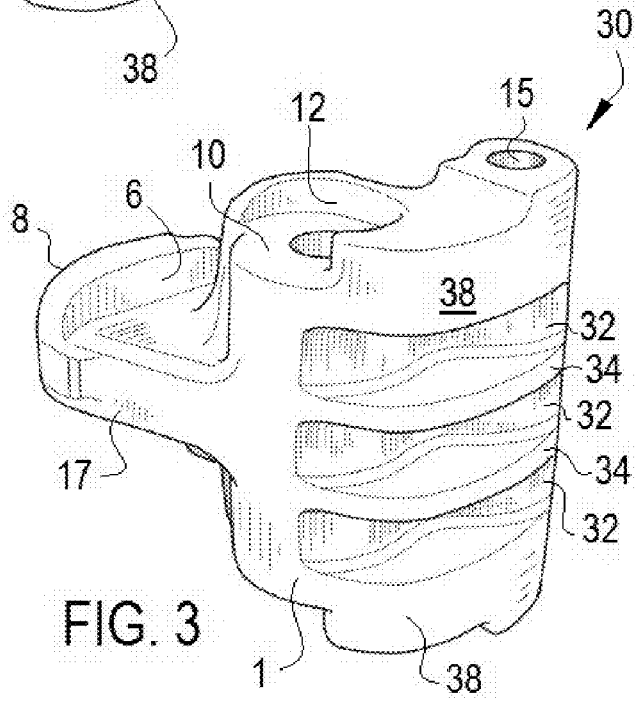

FIG. 3 is a perspective view of an E-type knuckle 30 according to one aspect of the present invention and is analogous to the knuckle 30 of FIG. 2 as this includes three external weight saving features 32 or pockets with intervening support ridges 34 on the front face 1 of the knuckle 30. The only difference between the embodiments of FIGS. 2 and 3 is that the bottom of the weight saving features 32 for the embodiment of FIG. 3 are contoured around the pin hole 11 and the flag hole 15, yielding greater weight savings without adversely affecting the strength/fatigue life of the coupler knuckle 30.

Figure 4:
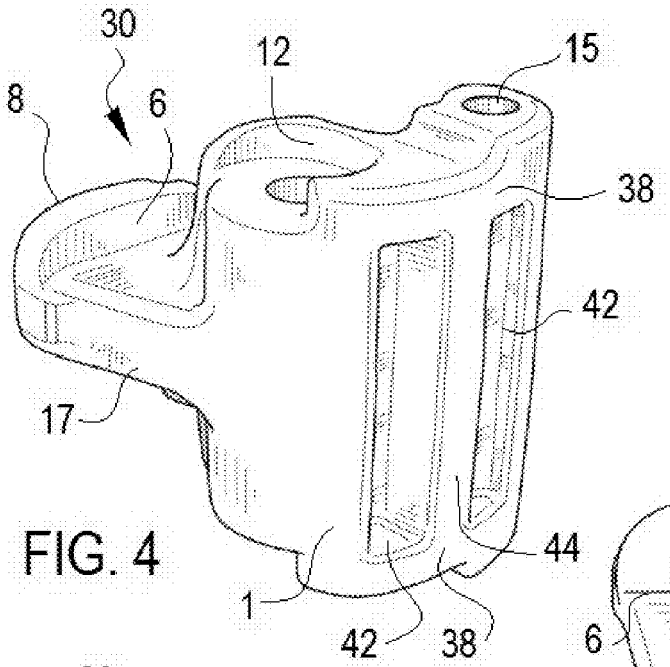
Figure 5:
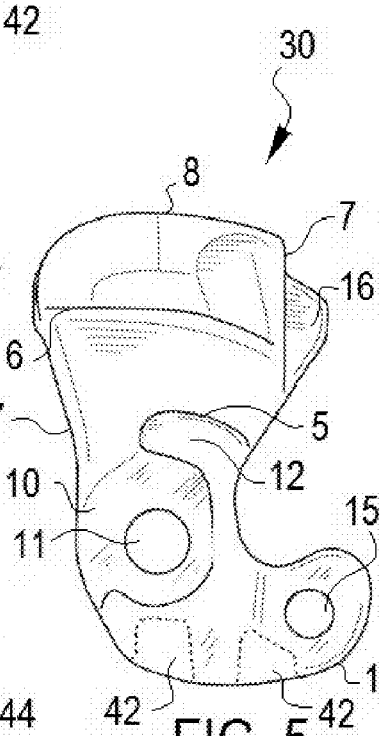
FIG. 5 is a top plan view of the E-type knuckle of FIG. 4 of the invention illustrating in phantom the depth of the vertical weight saving features.

FIG. 4 is a perspective view of an E-type knuckle 30 according to one aspect of the present invention and this includes two external weight saving features 42 or pockets with intervening support ridge 44 on the front face 1 of the knuckle 30. The bottom of the weight saving features 42 for this embodiment are flat, but could be contoured. Again these features of the railroad knuckle 30 of the present invention allows for formation of the knuckle through forging or coreless casting techniques. Forging allows for the use of a better grade of steel compared to AAR Grade E and such forging processes will yield much higher fatigue life compared to cast knuckles. The weight saving features 42 of FIG. 4 are substantially rectangular recesses (in front plan view) orientated vertically across the front face 1 generally along the length of the pivot pin hole 11. The support ridge 44 of FIG. 4 is a thick vertical structure extending across the front face 1. The rectangular recesses forming the weight saving features 42 of FIG. 4 extend to but not into the continuous surfaces 38 on the front face 1 on the top and the bottom of the front face 1. As noted above, the surfaces 38 have a vertical depth at least equal to the vertical depth of the pin protector 12. FIG. 5 is a top plan view of the E-type knuckle 30 of FIG. 4 of the invention illustrating in phantom the depth of the weight saving features 42. The bottom of the weight saving features 42 will be defined, as shown, by the relative position of the pin hole 11 and the flag hole 15, or more precisely by the material surrounding these elements. The bottom surface of the weight saving features 42 may be flat as noted, or contoured about the pin hole 11 or flag hole 15, and the side surface of these features 42 may have a draft angle defined by coreless casting or forging techniques.

Figure 6:
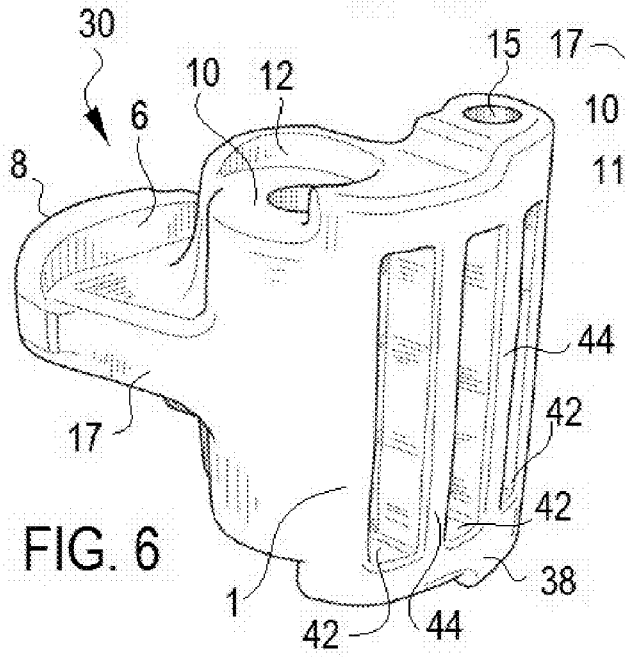
FIG. 6 is a perspective view of an E-type knuckle according to one aspect of the present invention which include three vertical external weight saving features with intervening support ridges on the front face of the knuckle.
Figure 7:
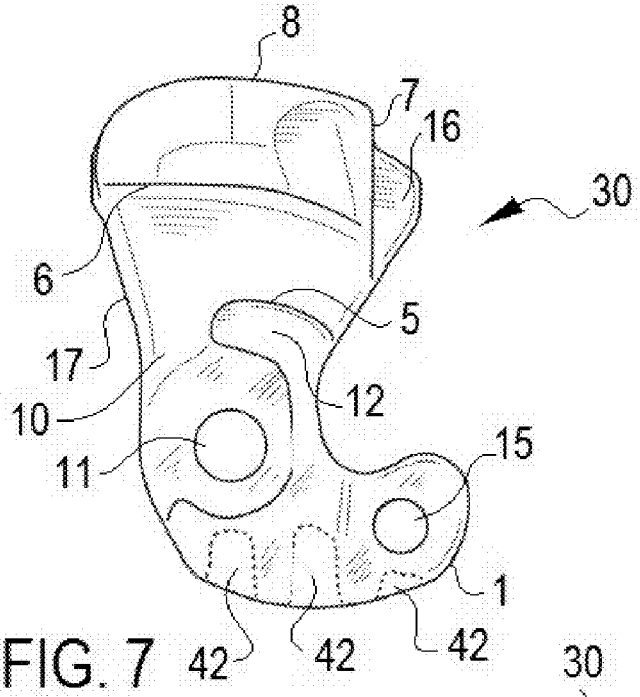
FIG. 7 is a top plan view of the E-type knuckle of FIG. 6 of the invention illustrating in phantom the depth of the weight saving features.

FIG. 6 is a perspective view of an E-type knuckle 30 according to one aspect of the present invention and this includes three external vertical weight saving features 42 or pockets or recesses with two intervening vertical support ridges 44 on the front face 1 of the knuckle 30. The bottom of the weight saving features 42 for this embodiment are also flat, but could be contoured as noted above. Again these structures of the railroad knuckle 30 of the present invention allows for formation of the knuckle through forging or coreless casting techniques. The weight saving vertical features 42 of FIG. 6 are substantially rectangular recesses (in front plan view) orientated vertically across the front face 1 generally along the length of the pivot pin hole 11. The support ridges 44 of FIG. 6 are vertical structures extending vertically across the front face 1. The rectangular recesses forming weight saving features 42 of FIG. 6 extend to but not into the continuous surfaces 38 on the front face 1 on the top and the bottom of the front face 1. FIG. 7 is a top plan view of the E-type knuckle 30 of FIG. 6 of the invention illustrating in phantom the depth of the features 42. The bottom of weight saving features 42 will be defined, as shown and noted above, by the relative position of the pin hole 11 and the flag hole 15, or more precisely by the material surrounding these elements.

Figure 8:
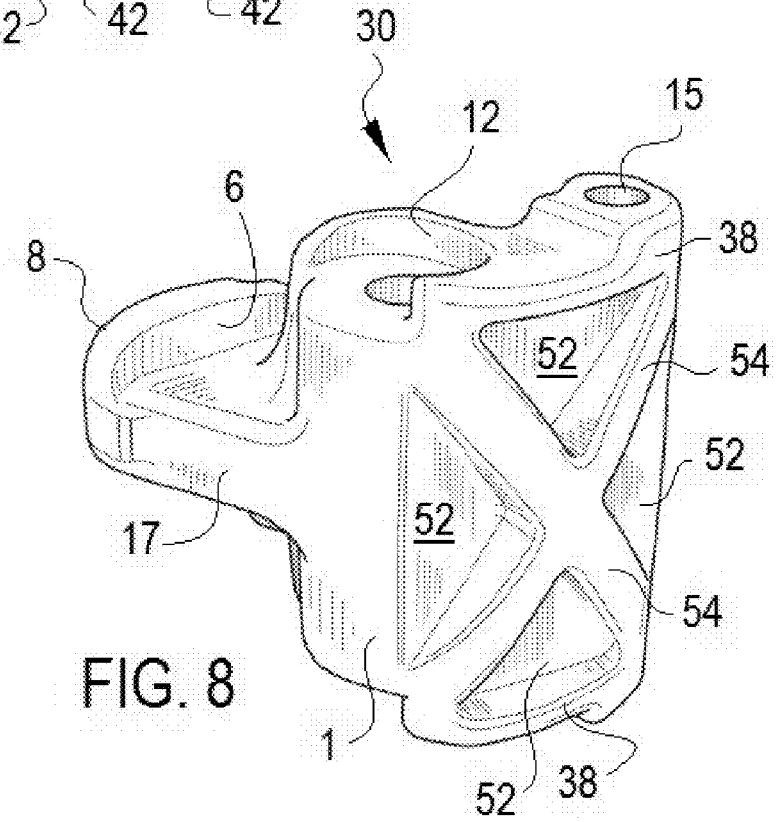
FIGS. 8-9 are perspective views of an E-type knuckle according to aspects of the present invention which include triangular external weight saving features with intersecting support ridges on the front face of the knuckle.
Figure 9:
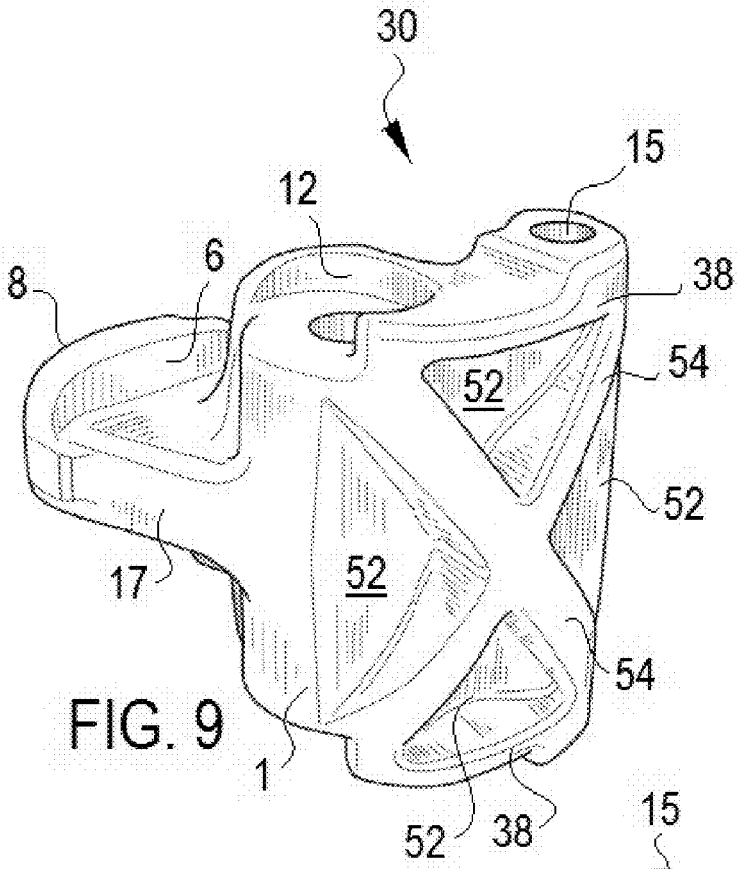

FIGS. 8-9 are perspective views of an E-type knuckle according to aspects of the present invention which include triangular external weight saving features 52 which define intersecting support ridges 54 on the front face 1 of the knuckle 30. These embodiments include four triangular external weight saving features 52 or recesses forming two intersecting support ridges 54 on the front face 1 of the knuckle 30, forming an X shape on the knuckle 30. The bottom of the weight saving features 52 for the embodiment of FIG. 8 are flat, but are contoured in the embodiment of FIG. 9. Again these weight saving features 52 of the railroad knuckle 30 of the present invention allows for formation of the knuckle 30 through forging or coreless casting techniques. The weight saving vertical features 52 of FIGS. 8 and 9 are substantially triangular recesses (in front plan view) orientated to form an X shape by the ridges 54. It is envisioned that rotation of the position of each of the weight saving features 52 by 45 degrees would be possible and yield a cross shape for intersecting ridges 54 (i.e. a vertical and a horizontal ridge 54). The support ridges 54 of FIGS. 8 and 9 are structures extending across the front face 1. The top and bottom weight saving features 52 of FIGS. 8 and 9 extend from the top or bottom continuous surfaces 38 on the front face 1.

It should be understood that the weight saving features 32, 42 and 52 above may be designed to include intersecting ridges. For example one or more vertical ridges could be added to intersect with the horizontal ridges 34 of FIGS. 2-3, and horizontal ridges could be added to intersect with the vertical ridge(s) 44 of FIGS. 4-7. A grid pattern of intersecting ridges may be easily implemented into the design of the present invention.

Figure 10:
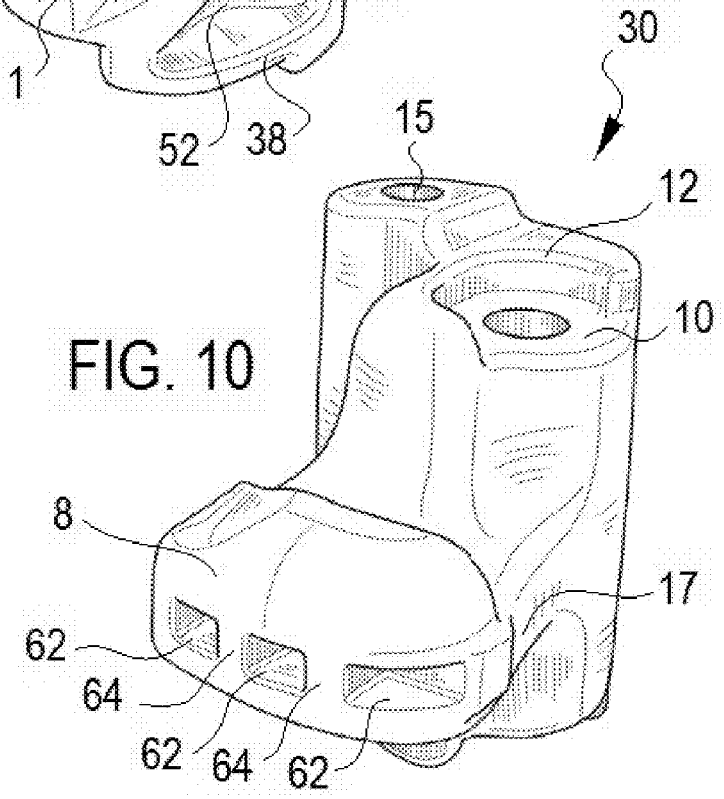
FIGS. 10-11 are perspective views of an E-type knuckle according to aspects of the present invention which include external weight saving features on the tail surface of the knuckle.
Figure 11:
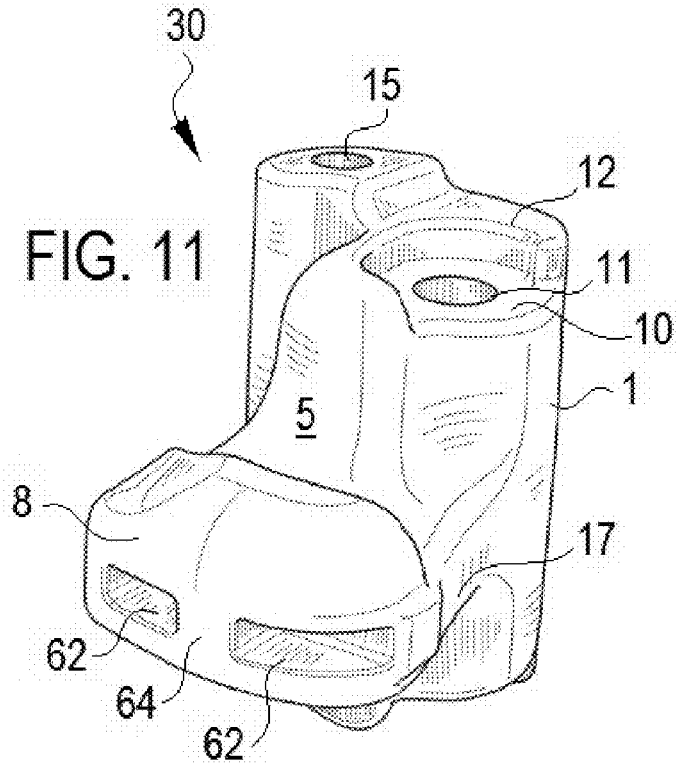

The present invention further includes external weight reducing features 62 in the tail surface 8 of the knuckle 30 as shown in the embodiments of FIGS. 10-11. Generally these will be one or more weight reducing features 62 in the tail. The embodiment of FIG. 10 shows three external weight saving features 62 with intervening vertical support ridges 64 on the tail surface 8 of the knuckle 30. The bottom of the weight saving features 62 for this embodiment are flat, but could be contoured. These structures of the railroad knuckle 30 of the present invention allow for formation of the knuckle 30 through forging or coreless casting techniques. The weight saving features 62 of FIG. 10 are substantially rectangular recesses (in a rear plan view) with the weight saving features 62 arranged in a line horizontally across the rear surface 8. The support ridges 64 of FIGS. 10-11 are vertical structures extending across the tail surface 8. The rectangular weight saving features 62 of FIG. 10 extend to a depth generally of the tail pad. The buffing shoulders 5 define the general depth of the weight saving features 62 as the weight saving features 62 will not adversely affect the fatigue life of the knuckle 30. The bottom surface of the features 62 may be flat as shown, or contoured about material needed for the buffing shoulders 5, and the side surface of these weight saving features 62 may have a draft angle defined by coreless casting or forging techniques. The embodiment of FIG. 11 shows two rectangular external weight saving features 62 with a single intervening vertical support ridge 64 on the tail surface 8 of the knuckle 30.

Figure 12:
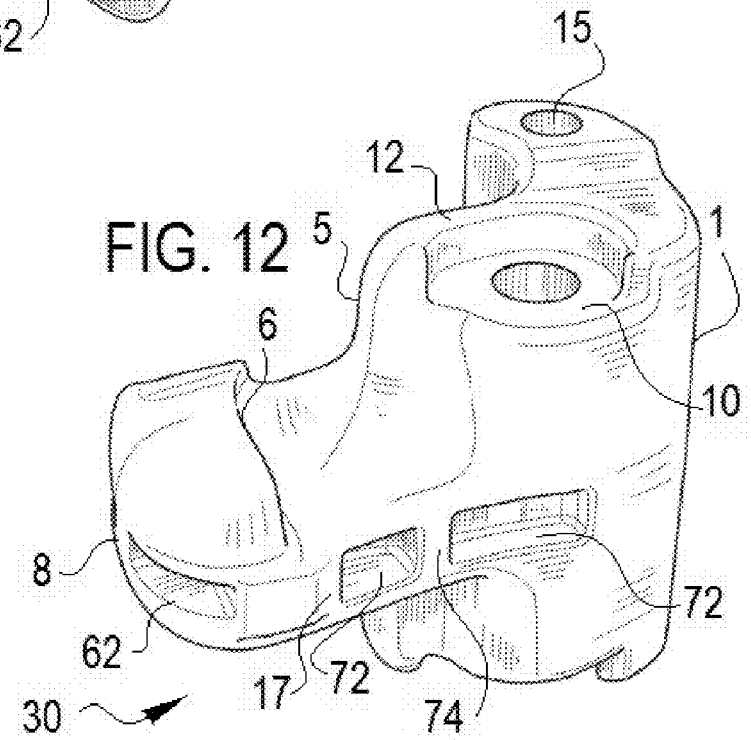
FIGS. 12-14 are perspective views of an E-type knuckle according to aspects of the present invention which include at least one external weight saving features on the spine surface of the knuckle.
Figure 13:
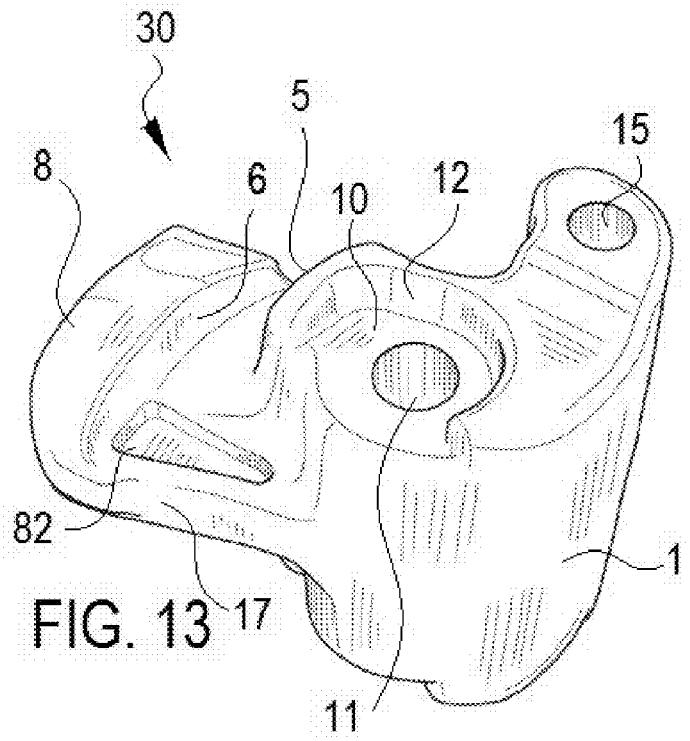
Figure 14:
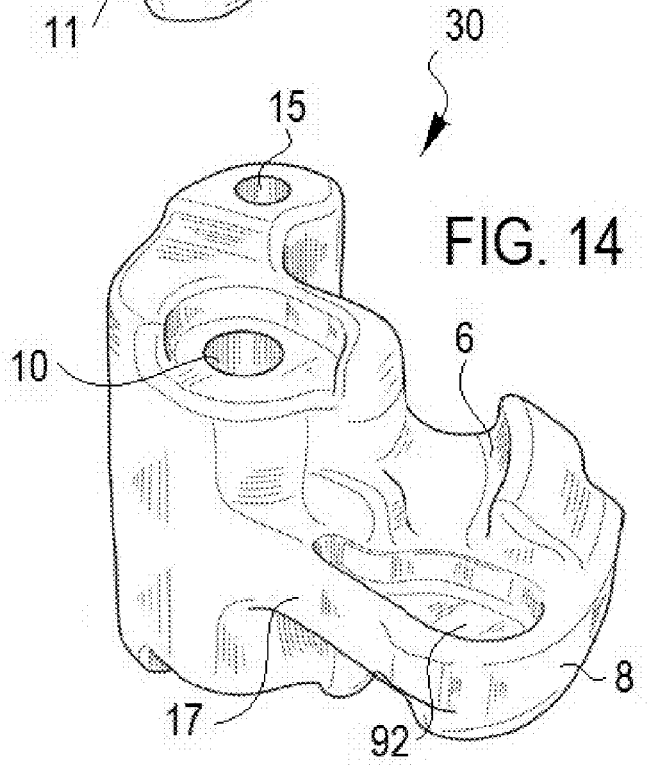

The present invention further includes external weight reducing features 72 or 82 or 92 in the spine 17 of the knuckle 30 as shown in the embodiments of FIGS. 12-14. These features of the railroad knuckle 30 of the present invention also allow for formation of the knuckle 30 through forging or coreless casting techniques.

FIG. 12 illustrates a series of rectangular external weight reducing features 72 in the side surface of the spine 17 of the knuckle 30 Generally these will be one or more weight reducing features 72 in the side of the spine 17 with intervening vertical support ridges 74 on the spine 17 of the knuckle 30 if two or more weight saving features 72 are present. The bottom of the features 72 for this embodiment are flat, but could be contoured. The support ridges 74 of FIG. 12 are vertical structures extending across the spine 17 as shown. The rectangular weight saving features 72 of FIG. 12 extend to a depth generally of the tail pad. The buffing shoulders 5 define the general depth of the weight saving features 72 as the weight saving features 72 will not adversely affect the fatigue life of the knuckle 30.

The embodiment of FIG. 13 shows a generally triangular or trapezoidal external weight saving feature 82 in a top surface of the spine 17 of the knuckle 30 positioned between the hub 12 and the pulling lug 6. The bottom surface of the weight saving feature 82 may be flat as shown or contoured as discussed generally above.

The embodiment of FIG. 14 shows an irregular shaped external weight saving feature 92 in a bottom surface of the spine 17 of the knuckle 30 positioned between the hub 12 and the buffing shoulder 5. The bottom surface of the pocket 92 may be flat as shown or contoured as discussed generally above.

The present invention contemplates forming the knuckle 30 to include the weight saving features on the front face 1, the tail surface 8 and the spine 17 as shown, and more significantly incorporating these weight saving features on a combination of these surfaces. For example FIG. 12 shows a knuckle according to the present invention which includes external weight savings features 62 on the tail and weight saving features 72 the spine 17 of the knuckle 30 of the present invention. Further, FIGS. 15A-D are views of a forged knuckle 30 according to the present invention which includes three external weight savings features 32 on the front face 1 and three weight saving features 62 on the tail surface 8 of the forged knuckle 30 of the present invention. The forged knuckle 30 shown in FIGS. 15A-D exhibits a weight of about 95 lbs compared with a forged knuckle without these features (FIGS. 1A-E) of about 105 lbs, and this knuckle 30 is shown to have extended fatigue life over a comparable core cast knuckle. Finally, FIGS. 16A-D are views of a forged knuckle 30 according to the present invention which includes three external weight savings features 32 on the front face 1 and three weight saving features 62 on the tail surface 8 of the forged knuckle 30 of the present invention, similar to the knuckle of FIGS. 15A-D. The forged knuckle 30 shown in FIGS. 16A-D utilizes the contoured or S-shaped bottom to weight saving features 32 and exhibits a weight of about 93 lbs and is also shown to have extended fatigue life over a comparable core cast knuckle. This demonstrates the additional weight savings (about 2% of the total knuckle 30 weight) through the addition of contouring of the bottom, and that the contouring has no adverse effect on the fatigue life of the knuckle 30. It is expected that incorporating these features in the front face the tail and the spine will result in total weight savings of up to 20%.

While the invention has been shown in several particular embodiments it should be clear that various modifications may be made to the present invention without departing from the spirit and scope thereof. The scope of the present invention is defined by the appended claims and equivalents thereto.

What is claimed is:

1. An E-type coupler knuckle comprising:

a front face configured to transmits the buff forces of the train; and at least two external weight saving pockets with at least one intervening support ridge on the front face of the knuckle extending into the knuckle from an exterior surface of the knuckle, and wherein each external weight saving pocket is a structure that is capable of being formed in one of a forging operation or casting operation without requiring an internal core.

2. The E-type coupler knuckle according to claim 1 including at least three external weight saving pockets and wherein each weight saving pocket is formed as a substantially rectangular recesses orientated horizontally across the front face.

3. The E-type coupler knuckle according to claim 2 wherein each support ridge is substantially uniform in thickness and extends horizontally across the front face.

4. The E-type coupler knuckle according to claim 2 wherein each rectangular recesses of each pocket extends at least 70% of the width of the front face.

5. The E-type coupler knuckle according to claim 2 wherein the knuckle includes a continuous surface on the front face on the top and the bottom of the front face into which the weight saving pockets do not extend.

6. The E-type coupler knuckle according to claim 5 wherein each continuous surface has a vertical depth at least equal to the vertical depth of a pin protector.

7. The E-type coupler knuckle according to claim 5 wherein the bottom of at least one weight saving pocket is contoured around a pin hole and a flag hole of the coupler.

8. The E-type coupler knuckle according to claim 2 wherein the bottom of each one weight saving pocket is contoured around a pin hole and a flag hole of the coupler.

9. The E-type coupler knuckle according to claim 1 including at least two external weight saving pockets orientated vertically across the front face generally along the length of a pivot pin hole of the coupler.

10. The E-type coupler knuckle according to claim 9 wherein the knuckle includes a continuous surface on the front face on the top and the bottom of the front face into which the weight saving pockets do not extend.

11. The E-type coupler knuckle according to claim 9 including at least three vertical external weight saving pockets.

12. The E-type coupler knuckle according to claim 1 including at least a pair of intersecting support ridges and wherein each external weight saving pockets is formed as a substantially triangular recesses.

13. The E-type coupler knuckle according to claim 1 further including at least two external weight saving pockets with at least one intervening support ridge on a tail of the knuckle extending into the knuckle from an exterior surface of the knuckle.

14. The E-type coupler knuckle according to claim 1 further including at least two external weight saving pockets with at least one intervening support ridge on a spine of the knuckle extending into the knuckle from an exterior surface of the knuckle.

15. The E-type coupler knuckle according to claim 1 further including an external weight saving pocket on a top of a spine of the knuckle extending into the knuckle from an exterior surface of the knuckle.

16. The E-type coupler knuckle according to claim 1 further including an external weight saving pocket on a bottom of a spine of the knuckle extending into the knuckle from an exterior surface of the knuckle.

17. A method of forming an E-type coupler knuckle having a front face configured to transmits the buff forces of the train and at least two external weight saving pockets with at least one intervening support ridge on the front face of the knuckle extending into the knuckle from an exterior surface of the knuckle, comprising the step of one of forging the coupler or casting the coupler without an internal core.

18. The method of forming an E-type coupler knuckle according to claim 17 wherein at least three external weight saving pockets are formed and wherein each weight saving pocket is formed as a substantially rectangular recesses orientated horizontally across the front face.

19. The method of forming an E-type coupler knuckle according to claim 17 wherein at least two external weight saving pockets are formed orientated vertically across the front face generally along the length of a pivot pin hole of the coupler.

20. The method of forming an E-type coupler knuckle according to claim 17 further including the step of forming at least two external weight saving pockets with at least one intervening support ridge on a tail of the knuckle extending into the knuckle from an exterior surface of the knuckle.

* * * * *